US006378231B1

(12) United States Patent
Moriya et al.

(10) Patent No.: US 6,378,231 B1
(45) Date of Patent: Apr. 30, 2002

(54) CONSTRUCTION MACHINE

(75) Inventors: Naoyuki Moriya; Hideto Furuta, both of Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 09/601,104

(22) PCT Filed: Nov. 10, 1999

(86) PCT No.: PCT/JP99/06251

§ 371 Date: Sep. 1, 2000

§ 102(e) Date: Sep. 1, 2000

(87) PCT Pub. No.: WO00/34591

PCT Pub. Date: Jun. 15, 2000

(30) Foreign Application Priority Data

Dec. 4, 1998 (JP) ..... 10-345761

(51) Int. Cl.[7] ..... E02F 5/02
(52) U.S. Cl. ..... 37/348; 701/50
(58) Field of Search ..... 37/348, 382, 414; 172/2, 4, 4.5; 414/699, 694; 701/50

(56) References Cited

U.S. PATENT DOCUMENTS 4,288,196 A * 9/1981 Sutton, II
4,757,454 A * 7/1988 Hisatake et al.
4,807,131 A * 2/1989 Clegg
5,395,199 A * 3/1995 Day, III et al.
5,404,661 A * 4/1995 Sahm et al.
5,799,419 A * 9/1998 Seo et al.
5,850,341 A * 12/1998 Fournier et al.
6,044,312 A * 3/2000 Sudo et al.
6,076,029 A * 6/2000 Watanabe et al.
6,131,061 A * 10/2000 Denbraber et al.
6,148,254 A * 11/2000 Barden
6,195,922 B1 * 3/2001 Stump

FOREIGN PATENT DOCUMENTS

| | | | |
|---|---|---|---|
| JP | 63-156126 | * | 6/1963 |
| JP | 62-291338 | | 12/1987 |
| JP | B2-3-61811 | | 9/1991 |
| JP | 6-322790 | | 11/1994 |
| JP | 7-207707 | | 8/1995 |
| JP | 8-219110 | | 8/1996 |

* cited by examiner

*Primary Examiner*—Victor Batson
(74) *Attorney, Agent, or Firm*—Oliff & Berridge, PCL

(57) ABSTRACT

In a construction machine provided with a control unit for outputting actuating commands to actuators based on operating signals from operating levers, interlocking relationships between the operating levers and the actuators can be set as desired respectively, while avoiding enlargement of the memory.

Interlocking relationships desired by an operator are adapted to be input into a control unit from a service tool, and the control unit is provided with a memory for rewritably storing the interlocking relationships thus input.

8 Claims, 5 Drawing Sheets

CONSTRUCTION MACHINE

BACKGROUND OF THE INVENTION

1. Field of Invention

The present invention relates to construction machines.

2. Description or Related Art

Generally, construction machines are provided with a plurality of actuators including swing motors, boom cylinders and so on, and a plurality of operating elements for operating these actuators. Some of the construction machines input operating signals from the operating elements to a control unit which then outputs actuating commands to the actuators on the basis of the operating signals thus input.

Hereupon, the interlocking relationship (operating pattern) between operating elements and actuators operated by the operation of the operating elements has not been conventionally standardized. The operating pattern thus varies depending upon the manufacturing companies, types and models of construction machinery, or JIS (Japanese Industrial Standards) specifications and the like. The operating pattern must be modified in conformity to an operator, but such modification of the operating pattern has been conventionally carried out by rearranging the piping connections between valves and actuators, which are actuated by means of operating elements. However, such rearrangement of piping connections are intricate, troublesome and provide poor workability.

It has been proposed in JP-A-3-61811, to store several kinds of operating patterns in a memory of a control unit in advance so that an operator can select a desired operating pattern from these operating patterns. However, if the desired operating pattern is not stored beforehand in the memory, the operator is unable to perform the desired operating pattern.

Meanwhile, it is conceivable to store all operating patterns in the memory. With such arrangement, at least 40320 kinds of operating patterns must be stored, for example, when extending and retracting a boom cylinder, a stick cylinder and a bucket cylinder, and right and left swinging actuations of a swing motor while using two joystick levers. Taking into account the operating patterns for various kinds of other operating elements including operating levers and operating switches, the number of operating patterns significantly increases. Furthermore, not only is a mass storage memory necessary to register all of such operating patterns, but selecting a desired operating pattern from such an enormous number of operating patterns is intricate.

Further, with JP-A-3-61811, since buttons and so on are provided around a drivers seat to modify the operating pattern, the pattern can be modified easily. However, the operator is often unaware of such a modification.

SUMMARY OF THE INVENTION

In various exemplary embodiments of the construction machine according to the invention, the construction machine includes a plurality of actuators, a plurality of operating elements for operating the actuators, and a control unit adapted to output actuating commands to the actuators based on operating signals from the operating elements input thereto, wherein data relating to interlocking between the operating elements and the actuators to be operated by the operating elements is input into the control unit, and the control unit is provided with a memory that stores the data thus input.

Specifically, the operating elements include operating levers, operating pedals, and operating switches, and the actuators are subjected to proportional control, ON-OFF control and toggle control. More specifically, the operating signals are given by sensors for detecting direction angle of the operating levers, and the actuators include a boom cylinder, a stick cylinder, a bucket cylinder and a swing hydraulic motor. Further, the operating signals are switching signals associated with the operating levers and operating pedals, and the actuators include a dozer cylinder, a tilting cylinder, and an angle cylinder.

DETAILED DESCRIPTION OF EXEMPLARY EMBODIMENTS

Figure 1:
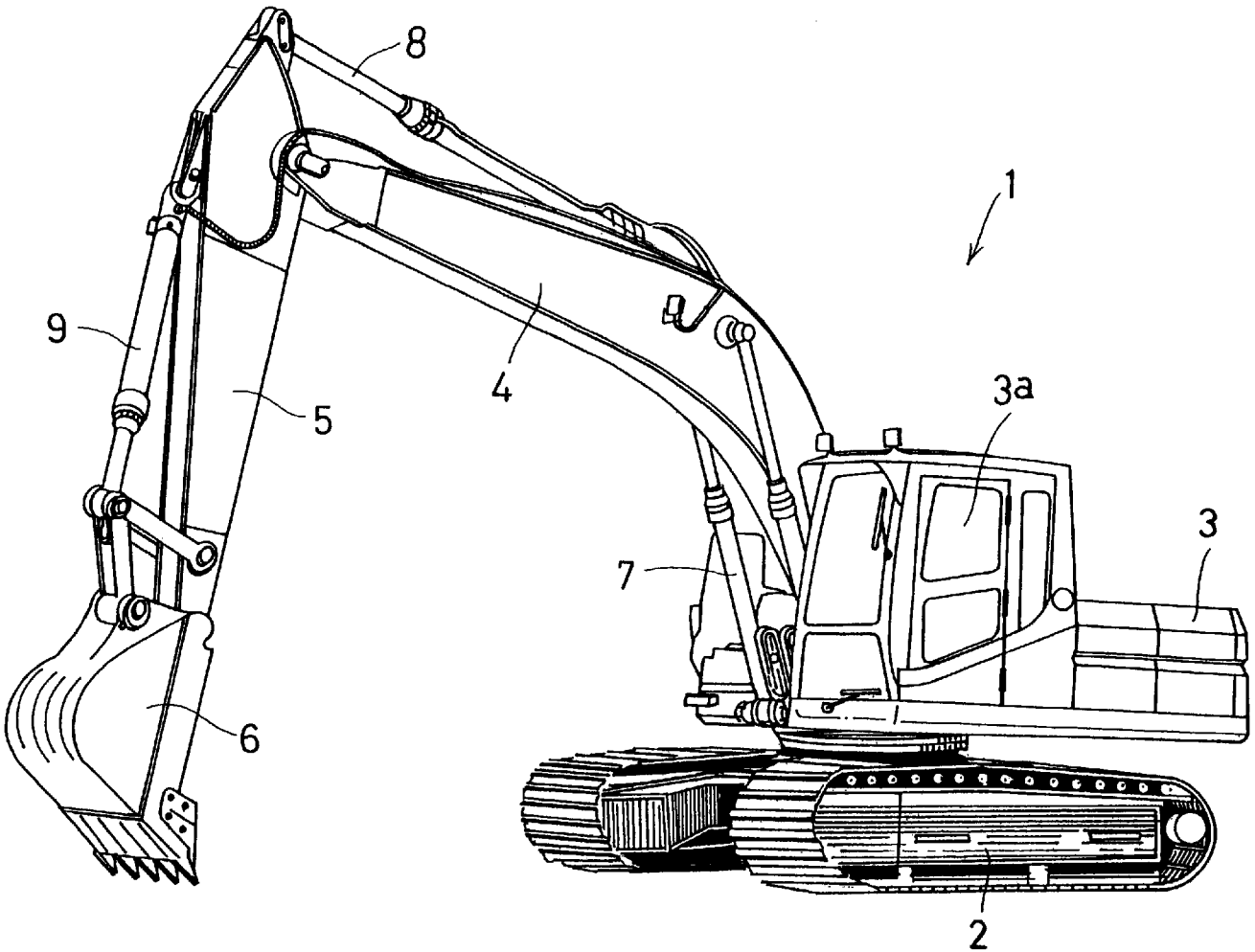
FIG. 1 is a perspective view showing a hydraulic shovel, to which a first embodiment is applied.
Figure 2:
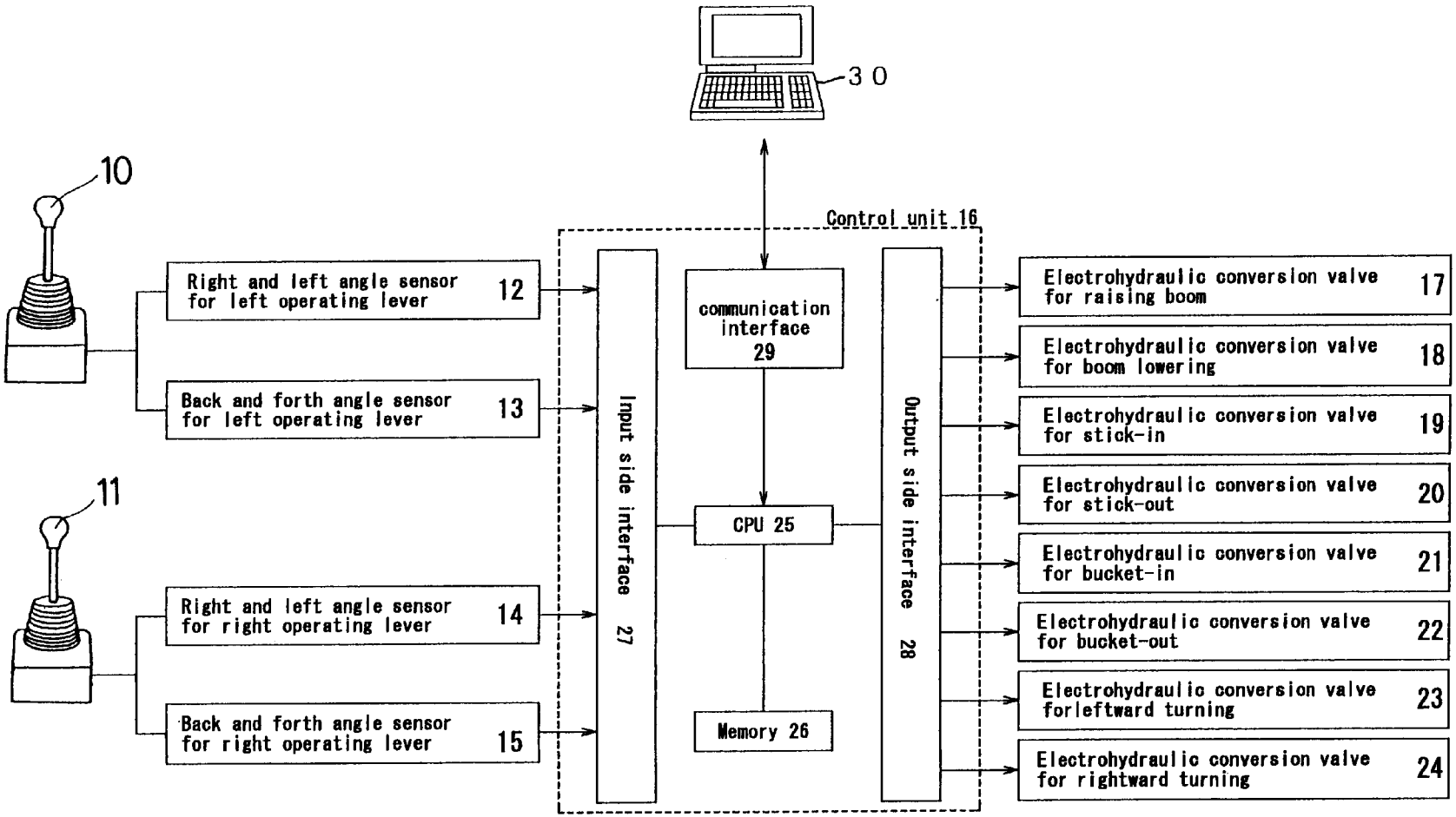
FIG. 2 is a block diagram showing inputs and outputs for a control unit.

An exemplary embodiment of the present invention will be described below with reference to FIGS. 1 and 2. The exemplary embodiment provides an example, in which operating directions of right and left operating levers 10, 11 and relationships of actuators to be operated by them respectively are modified. In the drawings, the reference numeral 1 designates a hydraulic shovel. The hydraulic shovel 1 comprises a crawler type lower structure 2, an upper structure 3 swingably supported on the lower structure 2, a boom 4 supported on the upper structure 3 to swing vertically, a stick 5 supported at the distal end of the boom 4 to swing back and forth and a bucket 6 supported at the distal end of the stick 5 to swing back and forth. The hydraulic shovel 1 is also provided with various kinds of hydraulic actuators such as boom cylinders 7, a stick cylinder 8 and a bucket cylinder 9 for swinging the boom 4, the stick 5 and the bucket 6, respectively, and a swing motor for swinging the upper structure 3. Thus, the hydraulic shovel of this embodiment has the same basic construction as in conventional hydraulic shovels.

Reference numerals 10, 11 denote joystick type right and left operating levers arranged in a operator's seat portion 3*a*, and operating amounts of right and left and back and forth direction of the operating levers 10, 11, are detected respectively by angle sensors such as a right and left angle sensor 12 for the left operating lever, a back and forth angle sensor 13 for the left operating lever, a right and left angle sensor 14 for the right operating lever, and a back and forth angle sensor 15 for the right operating lever. Detected values from these angle sensors 12 through 15 are adapted to be input to a control unit 16 to be described later.

Reference numerals 17 through 24 denote electrohydraulic conversion valves for controlling respective control valves (not shown) for the boom cylinders 7, the stick cylinder 8, the bucket cylinder 9 and a swing motor to effect boom ascending (expanding the boom cylinders), boom descending (contracting the boom cylinders), stick-in (expanding the stick cylinder), stickout (contracting the stick cylinder), bucket-in (expanding the bucket cylinder), bucket-out (contracting of the bucket cylinder), left swing and right swing. These electrohydraulic conversion valves 17 through 24 are set to operate so as to control these control valves on the basis of control commands from the control unit 16.

The control unit 16 comprises a CPU 25, a memory (which stores data rewritably and replaceably, for example, EEPROM) 26, an input side interface 27, and an output side interface 28. The control unit 16 is provided with a communication interface 29, through which a service tool 30, such as a notebook personal computer is adapted to be connected to the unit 16 by a serial transport.

The service tool 30 is connected to the control unit 16 as necessary, and a memory of the service tool 30 stores therein data concerning interlocking relationships (operating patterns) between the operating levers 10, 11 and the electrohydraulic conversion valves 17 through 24, which operate based on the operations of the operating levers 10, 11, respectively (or can read data from storage media such as floppy disks).

Here, operating patterns to be stored in the service tool 30 may be 40320 operating patterns in total, resulted from combining the operations of the electrohydraulic conversion valves 17 through 24 for boom ascending, boom descending, stick-in, stick-out, bucket-in, bucket-out, left swing and right swing, with respect to the operations of the operating levers 10, 11 in right and left, and back and forth directions. In the present embodiment, "boom ascending" and "boom descending", "stick-in" and "stick-out", "bucket-in" and "bucket-out", "left swing" and "right swing" are designed to be performed by operating the same operating lever 10 or 11 in opposite directions respectively, so that 384 operating patterns are stored.

An operating pattern that an operator desires is selected from the 384 operating patterns over a keyboard or the like in a state where the service tool 30 is connected to the control unit 16, thereby the operating pattern thus selected can be transferred to the control unit 16.

Meanwhile, in the case where an operating pattern is transferred from the service tool 30, the control unit 16 stores the operating pattern in the memory 26. When operating signals from the operating levers 10, 11 are input to the control unit 16, it outputs an actuating command to the corresponding electrohydraulic conversion valves 17 through 24 in accordance with the interlocking relationship of the operating patterns stored in the memory 26.

It should be noted that the operating patterns stored in the memory 26 of the control unit 16 are rewritten when the new operating pattern is transferred from the service tool 30.

Meanwhile, operating patterns, for example, of JIS specifications are stored as "standard operating patterns" in the memory 26 of the control unit 16 as the initial setting, and an actuating command is designed to be output to the electrohydraulic conversion valves 17 to 24 in accordance with the "standard operating patterns" in a stage prior to transference of the operating pattern from the service tool 30.

In the first exemplary embodiment, the interlocking relationships between the operating levers 10, 11 and the boom cylinders 7, the stick cylinder 8, the bucket cylinder 9 and the swing motor can be set as desired by connecting the service tool 30 to the control unit 16 and selecting an operating pattern, that an operator desires, from those stored in the memory of the service tool 30 and transferring the same to the control unit 16.

As a result, an operating pattern that an operator desires can be set in accordance with the operator's needs. In addition, since only the operating pattern transferred from the service tool 30 is stored in the memory 26 of the control unit 16, the volume of the memory 26 used can be reduced, thus avoiding enlargement of the memory 26.

Since the operating pattern is performed with the service tool 30 connected to the control unit 16, an operator can conveniently recognize that a new operating pattern is set.

Figure 3:
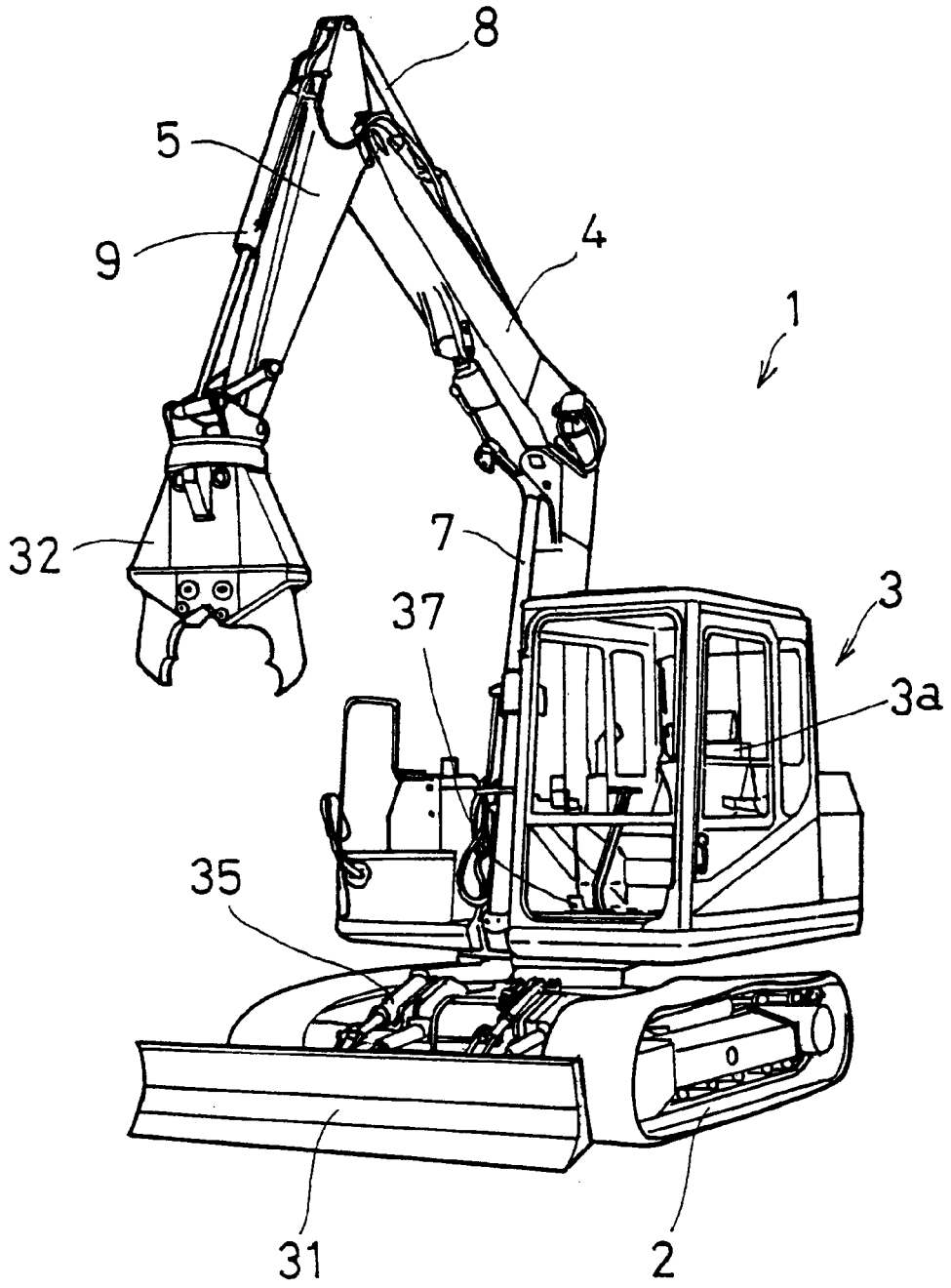
FIG. 3 is a perspective view showing a hydraulic shovel, to which a second embodiment is applied.
Figure 4:
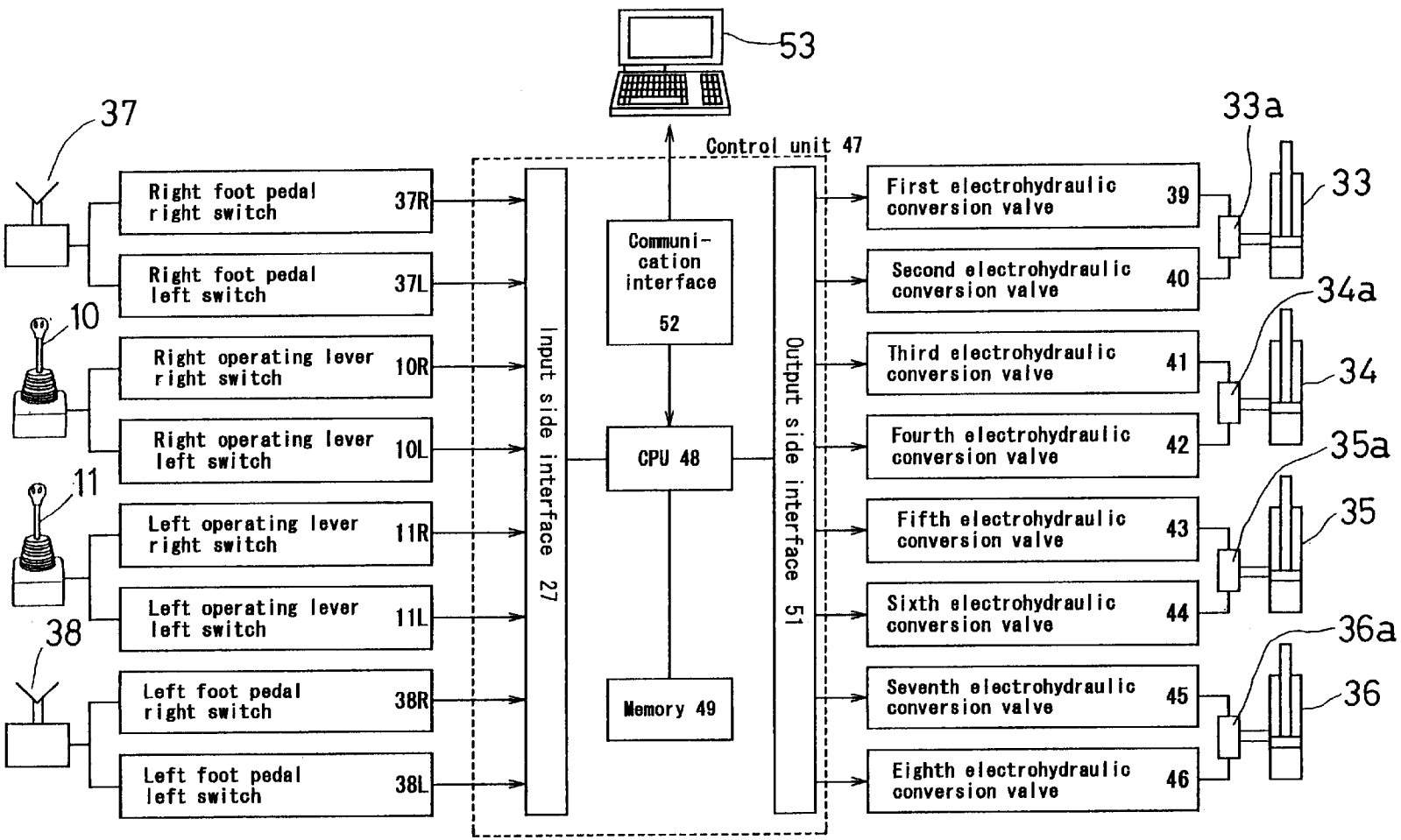
FIG. 4 is a block diagram showing inputs and outputs for a control unit.
Figure 5:
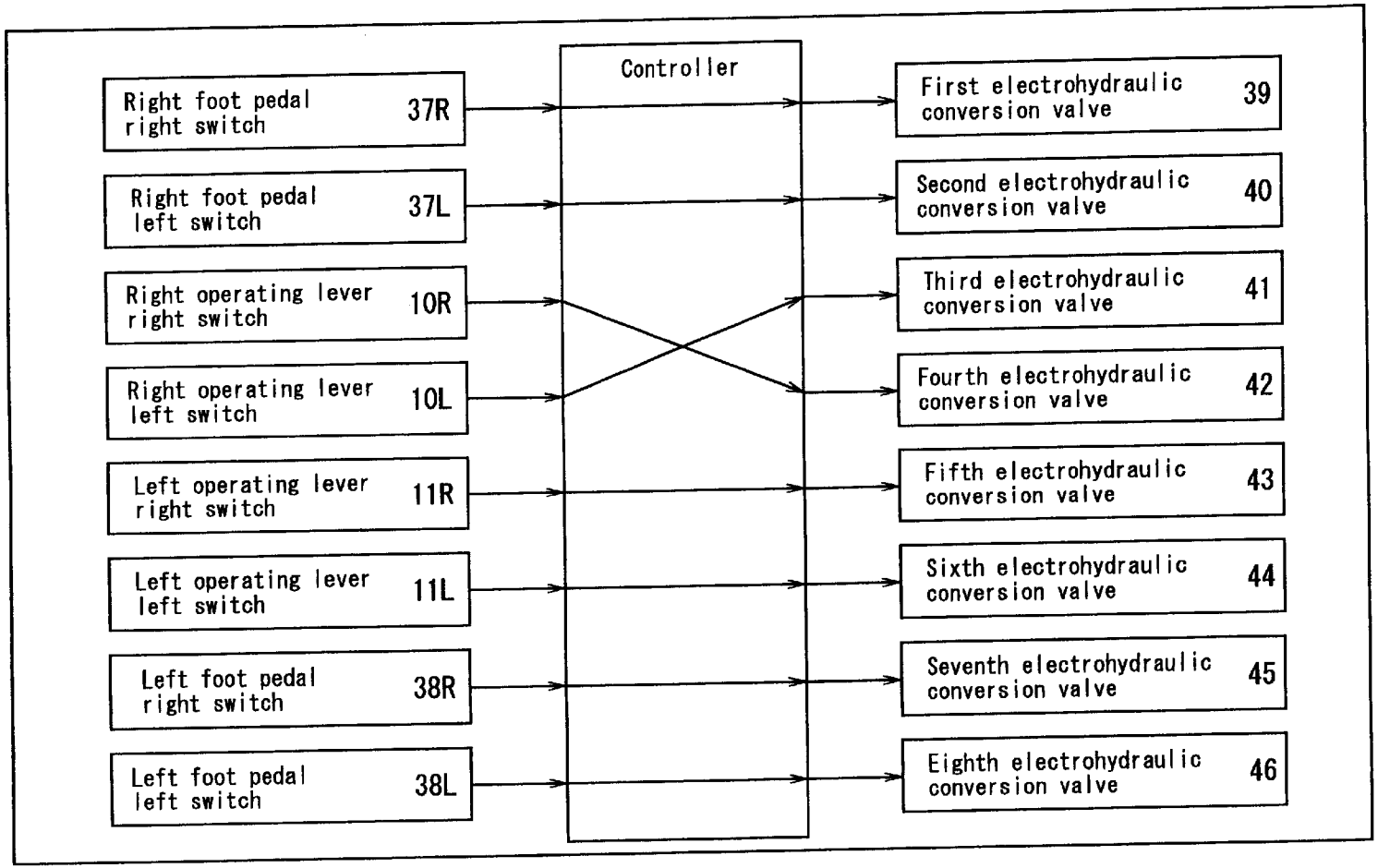
FIG. 5 is a representation of a display showing an example, in which each operating switch and each electrohydraulic conversion valve are related to each other.

A second embodiment will be described below with reference to FIGS. 3 to 5. In the embodiment, this machine has a tilting angle-dozer 31 and a crusher 32 as exterior type attachments, so that it is provided with a cylinder 33 for moving the dozer up and down, a cylinder 34 for tilting it, a cylinder 35 for angle changing, and a cylinder 36 for crushing.

Meanwhile, the right and left operating levers 10, 11 disposed on the upper structure 3 are provided on the right side and left side of grips thereof, with operating switches 1UR, 10L, 11R, 11L, respectively, and right and left foot pedals 37, 38 are located on the floor ahead of the operator's seat portion 3*a*. The right and left foot pedals 37, 38 are right and left treadles and detection switches 37R, 37L, 38R, 38L are provided for detecting treading on the right and left foot pedals 37, 38, respectively. Incidentally, to the crusher 32 is connected to the bucket cylinder 9 as a cylinder for swinging back and forth.

Further, the cylinder 33 for vertical movements of the dozer expands and contracts upon switchover of a first electrohydraulic conversion valve 39 and a second electrohydraulic conversion valve 40 whereby the dozer 31 is adapted to be moved vertically. Meanwhile, the tilting cylinder 34 is set to expand and contract upon switchover of third and fourth electrohydraulic conversion valves 41, 42 to tilt the dozer, whereas the cylinder 35 for angle changing is set to perform angle setting upon switchover of fifth and sixth electrohydraulic conversion valves 43, 44. Further, the crushing cylinder 36 is set to perform opening and closing operations of the crusher upon switchover of seventh and eighth electrohydraulic conversion valves 45, 46. In addition, the reference numeral 33*a* denotes a control valve for the cylinder 33 for vertical movements of the dozer, 34*a* a control valve for the tilting cylinder 34, 35*a* a control valve for the cylinder 35 for angle changing, and 36*a* a control valve for the crushing cylinder.

The foregoing first through eighth electrohydraulic conversion valves 39 through 46 perform switching operations upon receipt of control commands from a control unit 47. The control unit 47, like the first embodiment, is composed essentially of a CPU 48, a memory (which stores data rewritably or replaceably, for example, EEPROM) 49, an input side interface 50 and an output side interface 51. Further, the control unit 47 is also provided with a communication interface 52, through which a service tool 53, such as a notebook personal computer is adapted to be connected by means of serial communication.

The service tool 53 is connected as necessary to the control unit 47, and stores therein software associated with connecting relationships between the switches 10R, 10L, 11R, 11L, 37R, 37L, 38R, 38L and the first to eighth electrohydraulic conversion valves 39 to 46, respectively. Various settings are conceivable for such software, and one example thereof is as follows. Specifically, upon activation of the software, the switches 10R, 10L, 11R, 11L, 37R, 37L, 38R, 38L are indicated on a display in a vertical row on the left side, while the first to eighth electrohydraulic conversion valves 39 through 46 are indicated thereon in a vertical row on the right side. Setting can be achieved, for example, by clicking the left button of a mouse with a pointer of the mouse being brought on the indication of the right operating switch 10R at the right operating lever 10 to designate it, and then bringing the pointer for example, onto the indication of the fourth electrohydraulic conversion valve 42 and clicking the left button again, thus forming a relationship between them. The display indicates that the operating switch 10R and the fourth electrohydraulic conversion valve 42 are connected to each other by a line. Meanwhile, when this relationship is to be erased, a setting is possible such that the relationship is erased, for example, by double-clicking the line connecting the switch 10R and the valve 42 using the mouse. FIG. 5 shows an example of such a relationship. Such data can be registered in the built-in memory in the service tool 53, and can be stored in a storage medium such as a floppy disk. Further, the data can be output to the control unit 47 by means of serial communication as described previously to rewrite data having been stored with the new data to be stored therein.

In the second exemplary embodiment, it is possible to freely rearrange combinations of the foot pedals 37, 38 and the operating switches 10R, 10L, 11R, 11L with the first to eighth electrohydraulic conversion valves 39 through 46. Since the data thus rearranged cannot be rearranged unless the service tool 53 is used, inadvertent rearrangement is avoided.

It should be noted here that the present invention is not, of course, limited to the above embodiments. Thus, as means for inputting an operating pattern into the control unit 16, it is also possible to use a card-type storage medium such as an IC card, and a disk-type storage medium such as floppy disks and CD-ROM disks. In such case, an operating pattern that an operator desires is stored beforehand, for example, in an IC card. And the operator sets (inputs) the IC card in the control unit 16, whereby the operating pattern stored in the IC card is taken into the memory 26 of the control unit 16, and a control command is output in accordance with the interlocking relationship of the operating pattern.

Further, it is possible to employ a constitution in the above configuration, to store the same "standard operating patterns" as that in the embodiment described previously in the memory 26 of the control unit 16 so that in a state where no IC card is set, a control command is output in accordance with the interlocking relationship of the above-described "standard operating patterns", while in a state where an IC card is set, a control command is output in accordance with the interlocking relationship of the operating pattern stored in the IC card.

Thus, an operator can set a desired operating pattern by merely setting an IC card in the control unit 16 and can securely recognize setting of the operating pattern.

A modification with respect to proportional-type electrohydraulic conversion valves has been described in the first embodiment, and an example of ON-OFF changeover of switches has been described in the second embodiment. However, it goes without saying that the same can be implemented in various kinds of operating elements such as toggle switches.

What is claimed is:

1. A construction machine, comprising:

a plurality of actuators;

a plurality of operating tools for operating the actuators;

a control unit adapted to output actuating commands to the actuators based on operating signals from the operating tools input thereto;

data input means for inputting external data relating to interlocking between the operating tools and the actuators to be operated by the operating tools which is adapted to be connectable to the control unit; and a memory provided in the control unit for storing data relating to interlocking between the operating tools and the actuators to be operated by the operating tools, the memory rewriting or replacing the stored data relating to interlocking into or with the external data inputted by the data input means connected to the control unit.

2. The construction machine according to claim 1, wherein the operating tools comprise operating levers, operating pedals, and operating switches, and the actuators are subjected to proportional control, ON-OFF control and toggle control.

3. The construction machine according to claim 1, wherein the operating signals are given by sensors for detecting direction angle of operating levers, and the actuators comprise a boom cylinder, a stick cylinder, a bucket cylinder and a swing hydraulic motor.

4. The construction machine according to claim 1, wherein the operating signals are switching signals associated with operating levers and operating pedals, and the actuators comprise a dozer cylinder, a tilting cylinder, and an angle cylinder.

5. The construction machine according to claim 1, wherein the data input means includes either an IC card or a floppy disk.

6. A construction machine, comprising:

a control unit for outputting commands to the construction machine;

data input means for inputting external data relating to the commands which is adapted to be connectable to the control unit; and a memory provided in the control unit for storing data relating to interlocking between operating tools and actuators to be operated by the operating tools, the memory rewriting or replacing the stored data relating to interlocking into or with the external data inputted by the data input means connected to the control unit.

7. The construction machine according to claim 6, wherein the data input means includes either an IC card or a floppy disk.

8. A method of storing operating command for a construction machine, comprising the steps of:

inputting external data relating to interlocking between operation tools and actuators to be operated; and modifying the data so that it is rewriteable or replaceable.

* * * * *